United States Patent [19]

vom Hofe

[11] Patent Number: 4,723,690

[45] Date of Patent: Feb. 9, 1988

[54] METERING DISPENSER

[75] Inventor: Dieter vom Hofe, Cologne, Fed. Rep. of Germany

[73] Assignee: Henkel Kommanditgesellschaft auf Aktien, Duesseldorf, Fed. Rep. of Germany

[21] Appl. No.: 9,629

[22] PCT Filed: Nov. 30, 1984

[86] PCT No.: PCT/EP84/00377

§ 371 Date: Aug. 1, 1985

§ 102(e) Date: Aug. 1, 1985

[87] PCT Pub. No.: WO85/02598

PCT Pub. Date: Jun. 20, 1985

Related U.S. Application Data

[63] Continuation of Ser. No. 763,487, Aug. 1, 1985, abandoned.

[30] Foreign Application Priority Data

Dec. 8, 1983 [DE] Fed. Rep. of Germany ..... 3344412

[51] Int. Cl.[4] ..... B65G 59/06

[52] U.S. Cl. ..... 221/96; 221/266; 221/119; 221/288

[58] Field of Search ..... 206/536, 538, 539, 528, 206/216, 217; 222/130, 91; 221/96, 97, 265, 266, 288, 287, 113–115, 119, 120, 121, 82, 83, 91, 98, 185, 122

[56] References Cited

U.S. PATENT DOCUMENTS

| | | | |
|---|---|---|---|
| 2,886,209 | 5/1959 | Lerner | 221/287 |
| 3,095,109 | 6/1963 | Exton | 206/216 |
| 3,358,818 | 12/1967 | Davis | 206/536 |
| 4,051,977 | 10/1977 | Steinfeld | 221/96 |
| 4,150,766 | 4/1979 | Westendorf et al. | 221/119 |
| 4,432,300 | 2/1984 | Lyss | 221/91 |

FOREIGN PATENT DOCUMENTS

| | | | |
|---|---|---|---|
| 347595 | 1/1979 | Austria . | |
| 1586904 | 1/1972 | Fed. Rep. of Germany . | |
| 2052051 | 4/1972 | Fed. Rep. of Germany . | |
| 22822581 | 11/1979 | Fed. Rep. of Germany . | |
| 1423404 | 11/1965 | France . | |
| 1546080 | 10/1968 | France . | |
| 428689 | 5/1935 | United Kingdom | 206/216 |

*Primary Examiner*—H. Grant Skaggs

*Attorney, Agent, or Firm*—Ernest G. Szoke; Henry E. Millson, Jr.; Real J. Grandmaison

[57] ABSTRACT

With a metering dispenser (1) for compactates with a compactate store (3) and a metering disk (4) arranged pivotably around an axis (A) with respect to the store, containing several chambers (27) for accommodating individual compactates, in order to perform dispensing with sufficient reliability in the quantitative dispensing of the individual components in the household sector, given an essentially cylindrical design as well as relative rotatability of the store (3) and the metering disk (4) around the cylinder axis (A) the combination is provided with a metering cup (2) for liquid or free-flowing product. The metering dispenser (1) can be formed as a closure for a storage container accommodating one of the components, so that a multi-component package is present.

14 Claims, 11 Drawing Figures

Figure 4:
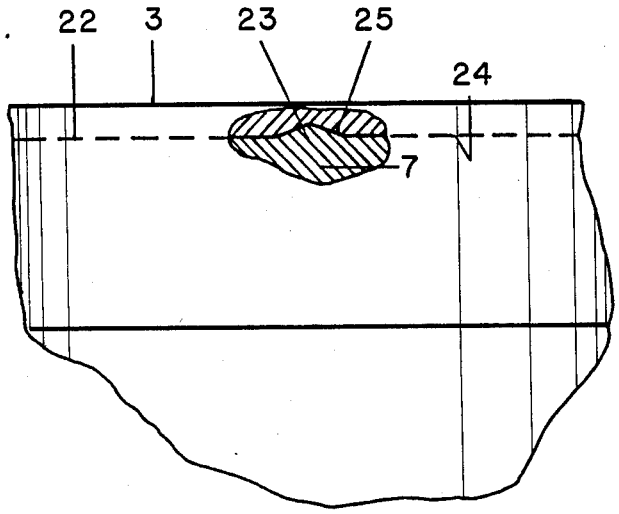

FIG. 1
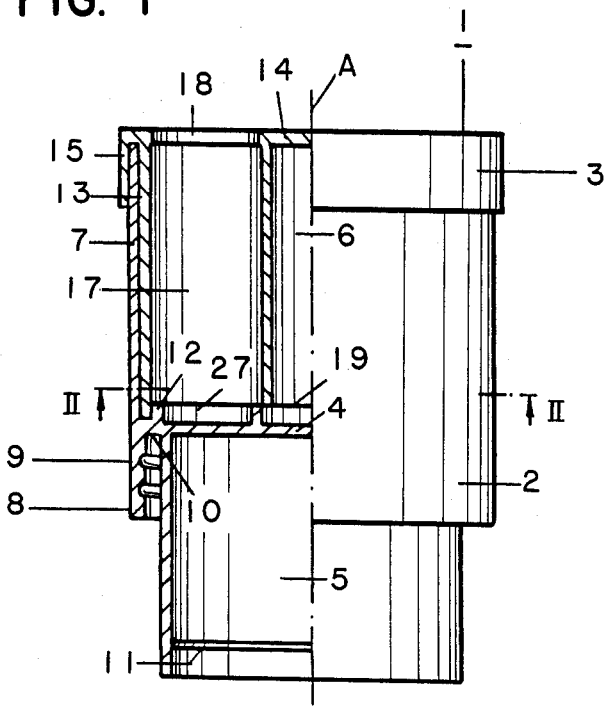
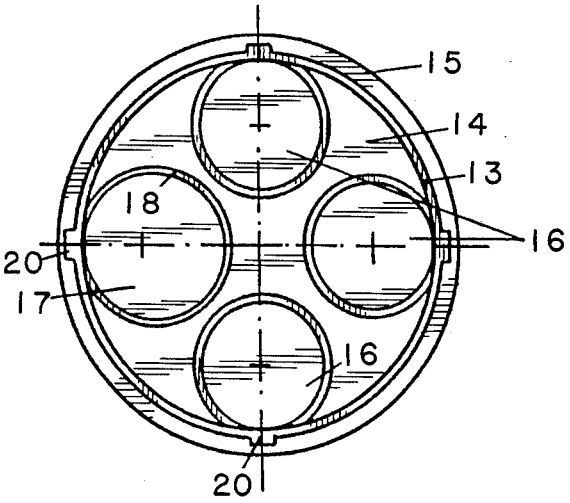
FIG. 2
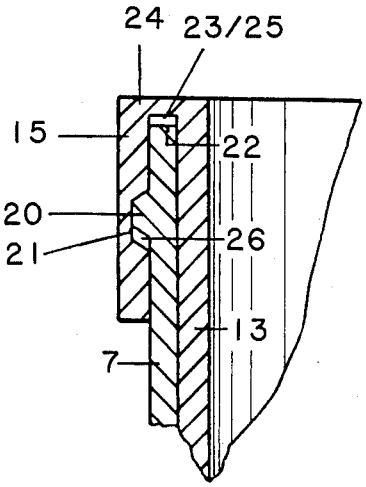
FIG. 3

METERING DISPENSER

This application is a continuation of application Ser. No. 763,487, filed Aug. 1, 1985, now abandoned.

The invention pertains to a metering dispenser for compactates, such as tablets, pills, capsules and granulates, with a compactate store and a metering disk arranged pivotably around an axis with respect to the store and containing several compactate receiving chambers.

A metering dispenser for tableted products of the above-mentioned type is described in German Preliminary Published Application No. 3,143,953. The known device has a supply container serving as a refilling unit or store and a stop adapter assigned to the supply container as well as a slide bearing with a construction element including a dispensing slide to be movably inserted. The device thus consists of a tablet supply container in variable cross sectional shape, a so-called dispensing slide and a basic element integrated therewith, having a slide rail and arresting adapter. To be sure the known device is universal, and is also suitable for use in the household sector, but no provisions are made for a specifically proportioned multicomponent dispensing action.

There are multicomponent products, the components of which are incompatible with one another to some degree or lose effectiveness when stored together for some time. In addition certain active ingredients of such multicomponent products can be manufactured and stored more economically and more effectively in tablet, pill or capsule form, while other production components more advantageously exist in free flowing or liquid form.

The invention is based on the goal of creating a metering dispenser for two or more components of a multicomponent product which are to be stored separate from one another and have different three-dimensional forms and/or aggregation states, wherein adequate reliability during quantitative metering of the individual components and convenient applicability are guaranteed, especially in the household sector. The solution in accordance with the invention is characterized for the metering dispenser of the initially mentioned type with a compactate store and a metering disk assigned to the store, containing compactate receiving chambers—or simply compactate chambers for short—by essentially cylindrical construction as well as relative rotatability of the store and the metering disk around the cylinder axis.

The metering dispenser in accordance with the invention can be attached as a separate metering device or as a metering attachment in place of the usual closure on the supply container containing one of the components to be dispensed. The connection can be formed in the usual manner, e.g., by screw threading, a snap closure or the like. For dispensing the substance contained in the supply container a metering cup is advantageously provided. This can be formed on the metering dispenser in such a manner that when placed on the supply container it enters the opening thereof. Alternatively, however, it is also advantageous to design the metering cup as a cuffed cover, especially a screw cover, of the metering dispenser or its store. In the latter case the dispensing disk and the store of the metering dispenser should have a penetrating opening—for example, positioned coaxially to the cylinder axis—as an outlet channel for the components contained in the supply container. Through this channel the product to be dispensed can be transferred from the supply container to the metering cup.

Metering dispensers or metering attachments in accordance with the invention can be produced at relatively little expense, since they consist of only two to three individual parts, which after filling with the respective product are attached together and remain joined together, possibly inseparably. If the metering dispenser is designed as a closure for the supply container holding the components, a multicomponent packing is produced after coupling the closure and the supply container.

In contrast to the metering dispenser according to DE-OS No. 3,143,953* the axis of rotation of the metering disk in accordance with the invention coincides with the cylinder axis of the corresponding compactate store. The compactate receiving chambers of the metering disk should thus be distributed over a circular pathway with the cylinder axis as midpoint. For dispensing, the store has a compactate ejection opening assigned to a pivot position of the metering disk and open in the direction of the corresponding compactate chamber, especially as an ejection shaft. Thus if a compactate reaches the bottom of the ejection opening by further turning of the metering disk, the product can be moved to the planned use location by tipping the metering dispenser or turning it upside-down. It is remarkable that for this purpose it is not necessary to touch the dispensed material with the hand.

*DE-OS: German Offenlegungsschrift (unexamined patent application).

The externally essentially cylindrical store can, in a first alternative, in addition to the ejection shaft or the like contain one or more storage shafts for receiving compactates, in such a manner that the base of the respective storage shaft in at least one pivot position of the metering disk comes into coincidence with one of its compactate receiving chambers. For example the ejection shaft and three storage shafts can be displaced through 90° with respect to one another, distributed on a circular pathway coinciding with the circular pathway of the compactate chambers. Other than through the cylindrical design as well as the relative rotatability of the store and metering disk and the cylinder axis this alternative of the object in accordance with the invention is preferably characterized by the combination with a metering cup for liquid or free-flowing product.

In another alternative the store in accordance with the invention, aside from the space required for the ejection shaft of the ejection opening, has an essentially undivided hollow chamber for receiving compactates to be metered. These individual bodies can lie at the base of the store on the open metering disk and, by rotating the metering disk, gradually be moved to the store-side entry of the ejection shaft or the like. Obviously, in this alternative also, combination with a metering cup for liquid or free-flowing product is advantageous.

The store is advantageously designed corresponding to the shape of the compactate to be dispensed. For example cylindrical compactate can better be introduced to the assigned compactate accommodating chambers of the metering disk if these tablets are already present in assigned compactate shafts. If on the other hand pills, capsules, granulates etc. with rounded forms are to be metered out, a preassigned introduction to the individual compactate receiving chamber, which can then for example have a cup shape, is not necessary, so that the store need not contain auxiliary means, such as storage shafts.

The ejection shaft should possess at least such a cross section that the respective compactate can drop out without difficulty, even in slanted fashion. The respective compactate receiving chamber in the metering disk should have approximately the same cross section as the ejection opening or the ejection shaft. According to a further invention, however, the ejection shaft can also cover two compactate receiving chambers, so that the user can see which compactate is the next to be dispensed or whether a compactate is already lying in the waiting position for the next metering. Here the base of the ejection shaft can be equipped with a passage for only one compactate and also have a slit opening for examining the adjacent compactate receiving chamber.

It is also advantageous for the handling of the metering dispenser if the store on its upper edge facing away from the metering disk has a margin extending beyond the adjacent upper edge of a cylinder formed on the metering disk, especially with lock coupling. In this manner a closed container for the compactate located in the store is created, which for the purpose of metering is to be tipped into the upside-down position and then turned back over.

The rotation of the metering disk necessary for bringing compactates into the ejection opening of the store is simplified if the relative positions of metering disk and store in which a compactate receiving chamber is aligned with an ejection opening are made recognizable by an engagement that is able to be felt or heard during the relative rotation. In order to achieve this, transverse grooves and steps can be provided at the appropriate angular interval on the adjacent edges of the store and the metering disk.

Figure 5:
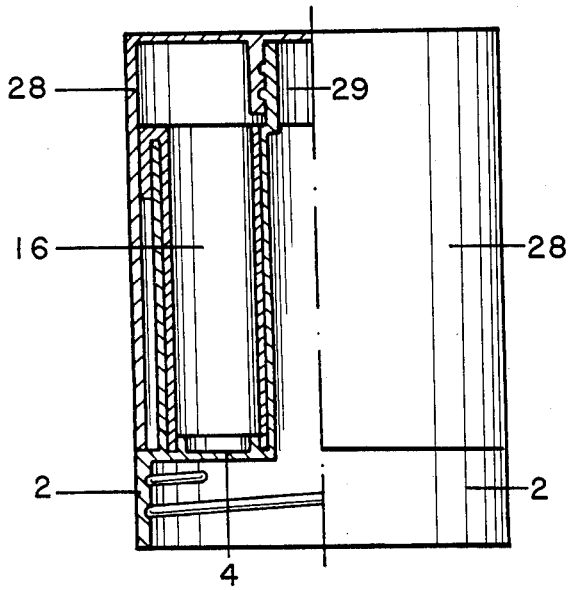
Figure 6:
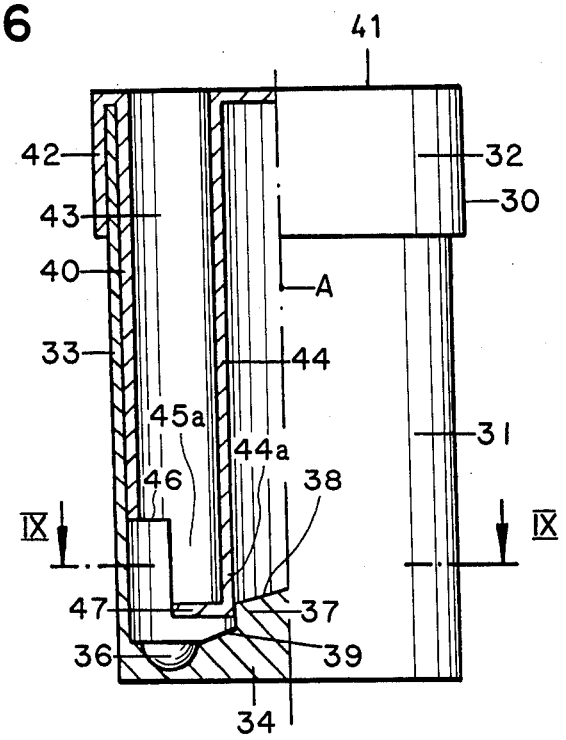
Figure 7:
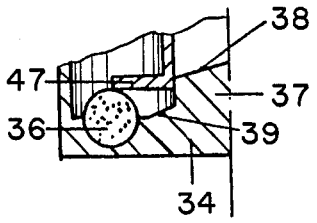
Figure 8:
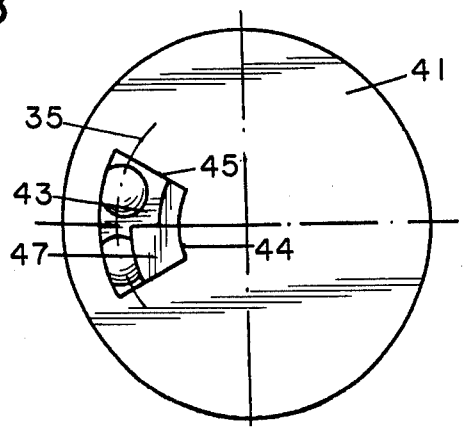
Figure 9:
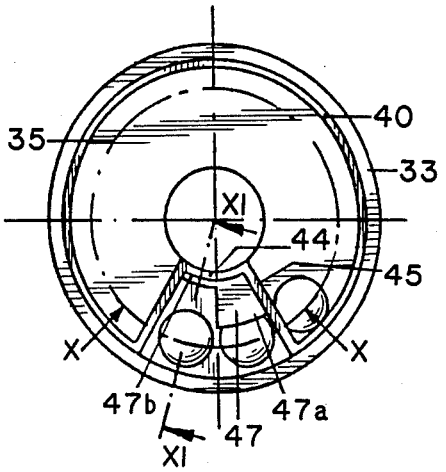

Details of the invention will be explained on the basis of the schematic representation of exemplified embodiments. These show the following:

FIG. 1 a longitudinal section, partially in front view, of a metering dispenser;

FIG. 2 a section along line II—II of FIG. 1;

FIG. 3 an enlarged section through an upper edge of the store;

FIG. 4 an enlarged side view of FIG. 3, partially cut away;

FIG. 5 a longitudinal section, partially in front view, of a second exemplified embodiment of a metering dispenser;

FIG. 6 a longitudinal view, partially in front view, of a third exemplified embodiment of a metering dispenser for use as a pill or capsule dispenser;

FIG. 7 a section of the base plate of the metering disk according to FIG. 6 with capsule in place;

FIG. 8 a top view of the metering dispenser according to FIG. 6;

FIG. 9 the cross section along line IX—IX of FIG. 6.

Figure 10:
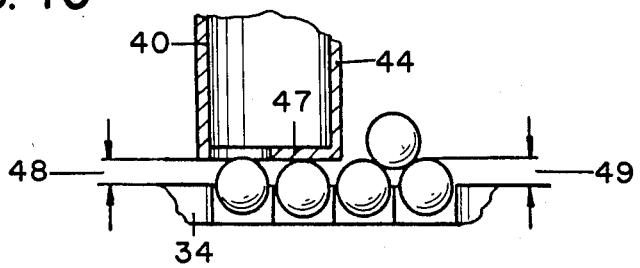
Figure 11:
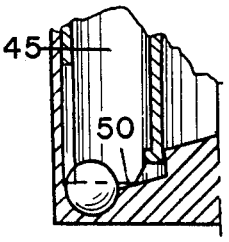

FIG. 10 a developed projection in the side view along the line X—X of FIG. 9; and FIG. 11 a longitudinal section along the line XI—XI in side view of FIG. 9.

The metering dispenser according to FIGS. 1 to 4, designated as a whole by 1, consists of a lower piece 2 and an upper piece 3 forming a store. The longitudinal and cylindrical axes A of the lower piece 2 and the upper piece 3 are identical.

The lower piece 2 is divided by a partition 4, designed as a metering disk, into two cylindrical chambers, opened toward the opposite ends, specifically a lower chamber 5 and an upper chamber 6. The cylindrical wall 7 of the upper chamber 6 is extended beyond the partition 4 at a distance corresponding to the cylinder wall of the lower chamber 5 by a cylindrical attachment 8 with internal threads 9, which serves for fastening the metering dispenser 1 on the neck or the other opening of a supply container, not shown. Any other type of coupling can also be provided between the metering dispenser 1 and the supply container.

Upon the screwing of the metering dispenser 1 provided in the exemplified embodiment onto a supply container, the cylindrical lower chamber 5, open downward, dips into the container opening. The container is sealed by the revolving face surface 10 in the channel between the cylindrical projection 8 and the cylinder wall of the lower chamber 5. The metering dispenser 1 according to FIG. 1, loosened from the container, when used as a metering device for the substance contained in the product container, is turned upside down with respect to the drawing shown, so that the lower chamber 5 directly forms the dispensing cup. Therefore it is advantageous to equip the subchamber 5, especially its inner wall, with a metering mark 11.

On the base of the cylindrical upper chamber 6 of the lower part 2, i.e., on the partition 4, four annular bridges 12, displaced through 90° with respect to one another, are formed.

The inner diameter of the bridge 12 should be slightly larger than the external diameter of the compactates to be introduced; the height of the bridge 12 should also slightly exceed the thickness of the compactates.

The upper part 3 of the metering dispenser 1 has a cylinder wall 13 with a head plate 14 and a surrounding marginal strip 15 extending over the cylinder wall 7 of the lower piece 2. On the head plate 14 and the cylinder wall 13, three cylindrical storage shafts 16 for receiving tablets or the like and an ejection shaft 17 are formed. The internal diameter of the tubular storage shaft 16 is specified to be slightly larger than the external diameter of the tablets. The internal diameter of the ejection shaft 17 is made of such a size that even a tablet dropping through at an angle can pass through the tubular shaft 17 in the overhead position without sticking. The ejection shaft 17 has assigned to it in the head plate 14 an interruption 18 corresponding to the inner diameter of the ejection shaft 17. When the lower piece 2 and the upper piece 3 are put together, the lower face surfaces 19 of the shafts 16 and 17 end shortly above the annular bridge 12 of the lower piece 2, while the cylinder wall 13 overlaps the annular bridge 12.

Details of the mode of functioning of the device described will be explained on the basis of FIGS. 1 to 4. Following the filling of the supply shaft 16 the lower piece 2 is pushed over the top piece 3. In this process for example an annular bead 20 of the outside of the cylinder wall 7 snaps into an annular groove 21 of the inside of the marginal strip 5.

On the surrounding face surface or upper edge 22 of the cylinder wall 7 of the lower piece 2, advantageously displaced at an angle of 90°, corresponding to the number of shafts 16 and 17, for roof-shaped cams 23 are provided, while in the surrounding channel or face surface 24 of the upper part 3 between the cylinder wall 13 and the marginal strip 15, four roof-shaped grooves 25 corresponding to the cams 23 are arranged in the plane formed by the cylinder axis and the respective shaft axis and displaced by 90° with respect to one another. If more or fewer than four shafts 16 and 17 are provided, obviously the angle by which the cams or grooves 23 and 25 are to be displaced with respect to one another on the cylinder circumference will vary.

Upon relative rotation of the bottom part 3 and the top part 2 around the cylinder or longitudinal axis A the cams and grooves 23, 25 engage in a manner that can be felt or heard. The relative displacement in the direction of the cylinder axis A of upper piece 3 and lower piece 2 necessary for this purpose is made possible by a suitable play 26 between the annular bead 20 and the annular groove 21. At the position at which the upper piece 3 and the lower piece 2 mesh in the cams and grooves 23, 25 in the case of relative rotation with respect to one another, the mid-lines of the shafts 16 and 17 of the upper part 3 stand exactly over the centers of the compactate chambers or indentations 27 formed by the annular bridges 12 (see FIG. 1).

Following the screwing of the metering dispenser 1 onto a container, from each tablet shaft 16 a tablet drops under its own weight into the compactate chamber 27 located beneath it. Through relative rotation of the top piece 3 through 90° with respect to the bottom piece 2, in the exemplified embodiment a tablet is pivoted beneath the ejection shaft 17 and can be tipped out by turning the metering dispenser 1 upside down.

An alternative exemplified embodiment of the metering dispenser 1 according to FIG. 1 is represented schematically in FIG. 5. This version, unchanged in function in terms of tablet uptake and release, has in place of the lower chamber 5 a measuring cup closure 28 to be set on from the top, which is to be screwed with a thread onto a channel 29 formed as a centrally arranged pour-out tube. The channel 29 in the exemplified embodiment projects through the partition wall 4 of the bottom piece 2 and through the entire upper piece 3 into the area above the storage and ejection shafts 16 and 17.

The exemplified embodiment of the metering dispenser 1 according to FIG. 5, after unscrewing the measuring cup closure 28 serving as a metering cap, permits a possibly even simultaneous metering of both liquid components and tablet components or the like into the metering cap without the metering dispenser having to be unscrewed.

On the basis of FIGS. 6 through 11 a pill or capsule dispenser designated overall by 30 will be explained, which alternatively, similarly to FIG. 1, can be produced as a metering attachment with molded-on lower chamber 5 or, similar to FIG. 5, with separate measuring cup closure 28 serving as a metering cap and corresponding pouring channel 29.

The metering dispenser 30 according to FIGS. 6 through 11 consists of a lower piece 31 and an upper piece 32 with common longitudinal or cylinder axis A. The lower piece 31 has a cylinder tube 33, the lower end of which is closed by a bottom plate 34 designed as a dispensing disk. The bottom plate 34 has calotte-shaped indentations or compactate chambers 36, located on an outer circular arc 35, and having a cross section corresponding to the half profile of the pills or capsules to be dispensed. In addition in the center of the base plate 34—in the absence of the pour-out channel 29—a cylindrical, internally projecting extension 37 with a slightly conical face surface 38 is provided. From the bottom edge of the extension 37 a circumferential, outwardly declining bevel 39 extends, reaching to the inner edge of the calotte-shaped chamber 36 with respect to the cylinder axis A.

The upper portion 32 of the metering dispenser 30 consists of a cylinder piece 40 with a head plate 41 and an edge 42 extending beyond the cylinder pipe 33 of the lower piece 31. In the head plate 41 a circular cut out-like penetration 43 is provided, from which downward, following the penetration profile, a cylindrical inner wall 44 as well as two side walls 45 extending radially to the cylinder axis, formed on the wall of the cylinder piece 40, as well as the cylinder piece itself originate, ending in the recess 46 beneath the side wall 45. The continuing wall parts or projections **44*a* and 45*a*, extending beyond the recess 46, in their lower region overlap the extension 37 projecting from the base plate 34. The projection 46 forms the shortened lower end of the cylinder wall in the region between the side walls 45. The shortening is intended to prevent sticking of the pills dropping from the chamber 36**; without the shortening a construction somewhat larger in diameter would be required.

The cylindrical inner wall 44 and the side walls 45 extending in the radial direction or their lower projections **44*a* and 45*a* are bound and stabilized at the end with the aid of a profiled base plate 47. The base plate 47 consists of a large surface partial piece 47*a* and a narrow partial piece 47*b*. The large surface partial piece 47*a* is designed such that from the ejection shaft it permits a glimpse into the calotte-shaped chamber 36 located beneath it, while the narrow partial piece 47*b* of the base plate 47 serves only for stabilizing the adjacent vertical walls 44, 45 and at the same time permits tipping out of a tablet lying in the preceding calotte-shaped chamber 36**.

The ejection shaft according to FIGS. 6 through 11 preferably has a cross section distinctly exceeding the diameter of the pills to be dispensed. There are two main reasons for this: On one hand a smaller shaft would present manufacturing problems, since such a shaft could not be cooled rapidly enough in the corresponding molding tool and thus would lead to increased length of the manufacturing cycles. On the other hand, with an injection shaft exactly covering two chambers in cross section, and by attaching the profiled base plate 47, and improved rigidity of the threads is created with respect to relative rotation, and the possibility is provided of keeping the pill planned for the following dispensing action positioned ready to use and stable with the aid of the partial piece **47*a*, while the preceding pill is being released by pivoting the dispenser; however, if the partial piece 47*a*** were not present in the exemplified embodiment, two pills would be removed simultaneously upon pivoting.

The distance 48 between the bottom edge or side of the base plate 47 and the upper edge, i.e., the highest elevation of the base plate 34 of the bottom piece 31, is selected to be slightly smaller than the pill half height 49 projecting beyond the calotte shaped chamber 36, in order that upon relative rotation of the upper piece 32 with respect to the lower piece 31 the lowest possible starting point of the lower edge corner of the base plate 47 with respect to pills or capsules lying in the chambers 36 will be obtained, preventing sticking. The radial side wall 45 adjacent to the large area partial piece **47*a* of the base plate 47 on its lower side has a recess (not shown), adapted to the pill profile located above it, while the opposite side wall 45 ends in a profile—FIG. 11—approximately following the base plate 34 of the lower piece 31**.

The filling of the metering dispenser 30 according to FIG. 6 takes place via a loose pouring into the turned-over upper part 32. After filling, the lower part 31 is pushed over the upper part 32 and retained—for example similarly to the metering dispenser 1 according to FIG. 1. After pivoting the dispenser into the position "top part up", the pills or capsules admitted drop into the exposed calotte-shaped chambers 36 of the base plate 34. Through relative rotation of the upper piece 32 with respect to the lower piece 31—counterclockwise in the exemplified embodiment—through two calotte segments, upon tipping the metering dispenser 30 into the overhead position a pill or capsule can be removed. Upon any further rotation through one calotte segment and repeated overhead tipping in each case an additional pill or capsule is released. In this exemplified embodiment, for releasing the second pill in each case no renewed pivoting (out of or into the overhead position) is required, but only a further rotation around the cylinder axis A.

Naturally the metering dispenser 30 according to FIGS. 6 through 11 can be equipped with similar stops for relative rotation of the upper and lower pieces as the metering dispenser 1 according to FIG. 1. When transparent or translucent material is used for the lower piece 31 it will be possible for the user in this exemplified embodiment as well to observe the complete residual emptying down to the last compactate and remember to refill the dispenser in time.

I claim:

1. A metering dispenser for compactates such as tablets, pills, capsules and granulates: said dispenser comprising a cylindrical compactate store having an upper piece and a lower piece engageable and disengageable with each other; said upper piece and said lower piece also being rotatable relative to each other around the longitudinal axis of said compactate store; said lower piece being partitioned into an upper chamber and a lower chamber by a metering disk with its center being at said longitudinal axis, said upper chamber being defined by a cylinder wall, said metering disk having a plurality of compactate receiving chambers defined by four annular bridges spaced at 90° intervals around said longitudinal axis, wherein the inner diameter of said bridges is slightly larger than the external diameter of said compactates; said upper piece comprising a cylinder wall, a head plate, and a surrounding marginal strip extending over the cylinder wall of said lower piece; wherein mounted within the cylinder wall of said lower piece between said head plate and said metering disk are located a plurality of cylindrical storage shafts for receiving said compactates and an ejection shaft for ejecting said compactates through an outlet opening in said head plate, said storage shafts and said ejection shaft having assigned pivot positions with respect to said metering disk.

2. A metering dispenser in accordance with claim 1 wherein the relative positions of said metering disc and said ejection shaft are made recognizable by an engagement device that may be felt or heard during the relative rotation of said upper piece and said lower piece.

3. A metering dispenser in accordance with claim 2 wherein said engagement device comprises cams located on the upper edge of the cylinder wall of said lower piece, and grooves located on the face surface of said upper piece between said cylinder wall and said marginal strip, wherein said cams and said grooves are at positions corresponding to said storage shafts and said ejection shaft.

4. A metering dispenser in accordance with claim 1 wherein said cylindrical wall of said upper piece extends to said metering disk from the top of the cylinder wall of said lower piece, said lower piece, at a position below said metering disk being provided with a cylindrical attachment having internal threads.

5. A metering dispenser in accordance with claim 4 wherein said cylindrical attachment is adapted to couple said metering dispenser to a supply container.

6. A metering dispenser in accordance with claim 1 wherein said lower piece has an opening in its bottom section.

7. A metering dispenser in accordance with claim 1 wherein said storage shafts have an internal diameter which is slightly larger than the external diameter of said compactates.

8. A metering dispenser in accordance with claim 1 wherein said ejection shaft has an internal diameter which is larger than the external diameter of said compactates.

9. A metering dispenser in accordance with claim 1 wherein the lower face surfaces of said storage shafts and said ejection shaft end just short of said annular bridges.

10. A metering dispenser in accordance with claim 1 wherein said cylindrical storage shafts comprise three storage shafts.

11. A metering dispenser in accordance with claim 10 wherein said three storage shafts and said ejection shaft are spaced at 90° intervals around said longitudinal axis.

12. A metering dispenser in accordance with claim 1 wherein said compactate receiving chambers are distributed over a circular pathway with said cylindrical axis as midpoint.

13. A metering dispenser in accordance with claim 12 wherein said compactate receiving chambers have approximately the same diameter as the ejection shaft.

14. A metering dispenser in accordance with claim 1 wherein said upper piece and said lower piece are engageable and disengageable with each other by an annular bead located on the outside surface of the cylinder wall of said lower piece, and an annular groove located on the inside surface of said marginal strip of said upper piece.

* * * * *